US006915763B2

(12) United States Patent
Arisawa et al.

(10) Patent No.: US 6,915,763 B2
(45) Date of Patent: Jul. 12, 2005

(54) ENGINE COOLING DEVICE AND ENGINE COOLING METHOD

(75) Inventors: Katuhiko Arisawa, Nishikamo-gun (JP); Shigetaka Yoshikawa, Nishikamo-gun (JP); Yoshikazu Shinpo, Nissin (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 10/806,412

(22) Filed: Mar. 23, 2004

(65) Prior Publication Data

US 2004/0187805 A1 Sep. 30, 2004

(30) Foreign Application Priority Data

Mar. 31, 2003 (JP) ..... 2003-096645

(51) Int. Cl.[7] ..... F01P 11/02
(52) U.S. Cl. ..... 123/41.14
(58) Field of Search ..... 123/41.14, 41.01; 237/44, 75

(56) References Cited

U.S. PATENT DOCUMENTS 2,016,179 A * 10/1935 Rosenqvist ..... 123/41.14
5,435,277 A * 7/1995 Takahashi ..... 123/142.5 E
5,662,072 A * 9/1997 Suzuki et al. ..... 123/41.14
5,730,089 A * 3/1998 Morikawa et al. ..... 123/41.14
5,749,329 A * 5/1998 Thurfjell ..... 123/41.14
6,477,990 B2 * 11/2002 Toyoshima et al. ..... 123/41.14
6,532,911 B2 * 3/2003 Suzuki et al. ..... 123/41.14
6,718,925 B2 * 4/2004 Toyoshima et al. ... 123/142.5 R
6,742,480 B2 * 6/2004 Onimaru et al. ..... 123/41.01

FOREIGN PATENT DOCUMENTS

JP A 10-77839 3/1998

* cited by examiner

*Primary Examiner*—Henry C. Yuen
*Assistant Examiner*—Jason Benton
(74) *Attorney, Agent, or Firm*—Kenyon & Kenyon

(57) ABSTRACT

The invention provides an engine cooling device capable of suitably promoting the warm-up of an engine. This engine cooling device comprises a cooling circuit and a heat-accumulating passage. The cooling circuit is composed of a radiator passage, a bypass passage, and a flow rate control value for controlling the flow rate of coolant flowing though the bypass passage. The heat-accumulating passage is provided with a heat-accumulating container, and constitutes a heat-accumulating circuit for causing coolant in the heat-accumulating container to circulate via the engine. The cooling device completes the heat-accumulating circuit by connecting the heat-accumulating passage to the cooling circuit to supply the cooling medium in the heat-accumulating container to the body of the engine, opens the flow rate control valve to increase a flow rate of cooling medium flowing though the bypass passage, then disconnects the heat-accumulating passage from the cooling circuit, and closes the flow rate control valve.

21 Claims, 7 Drawing Sheets

FIG. 4

ENGINE CONTROL DEVICE CONTROL PATTERN

| | ELECTRIC WATER PUMP | FLOW RATE CONTROL VALVE | OPEN-CLOSE VALVE | THREE-WAY VALVE | THERMOSTAT |
|---|---|---|---|---|---|
| WHEN ENGINE IS STARTED IN COLD STATE (PREHEAT HAS NOT BEEN COMPLETED) | DRIVEN | FULLY OPEN | OPEN | ALL PORTS OPEN (HEATER PASSAGE/ HEAT-ACCUMULATING PASSAGE: OPEN) | CLOSED |
| WHEN ENGINE IS STARTED IN COLD STATE (PREHEAT HAS BEEN COMPLETED) | STOPPED | FULLY CLOSED | CLOSED | ALL PORTS CLOSED (HEATER PASSAGE/ HEAT-ACCUMULATING PASSAGE: CLOSED) | |
| WHEN ENGINE IS STARTED IN HOT STATE | | | | | |
| IMMEDIATELY AFTER ENGINE HAS BEEN STARTED (FiA < FiX) | | | | | |

ENGINE

REQUEST TO START ENGINE

FLOW RATE CONTROL VALVE

OPEN-CLOSE VALVE

THREE-WAY VALVE

ELECTRIC WATER PUMP

ENGINE COOLING DEVICE AND ENGINE COOLING METHOD

INCORPORATION BY REFERENCE

The disclosure of Japanese Patent Application No. 2003-096645 filed on Mar. 31, 2003 including the specification, drawings and abstract is incorporated herein by reference in its entirety.

BACKGROUND OF THE INVENTION

1. Field of Invention

The invention relates to an engine cooling device/method designed to cool an engine through circulation of cooling medium.

2. Description of Related Art

As an engine cooling device designed to cool an engine through circulation of cooling medium, a cooling device equipped with a heat-accumulating container has been known. A cooling device of this type causes cooling medium that has reached a high temperature by receiving heat from an engine to flow into a heat-accumulating container, and thereby makes it possible to thermally insulate and store the cooling medium.

As an engine cooling device equipped with a heat-accumulating container, there is known a device that is disclosed in Japanese Patent Application No. 10-77839 as an example of the related art. This cooling device is constructed as follows.

That is, a radiator passage and a bypass passage are provided as cooling medium passages for causing cooling medium to flow. The radiator passage is designed to cause cooling medium that has flown out from a body of an engine to flow into the body of the engine via a radiator. The bypass passage is designed to cause cooling medium that has flown out from the body of the engine to flow into the body of the engine without causing the cooling medium to flow via the radiator.

The bypass passage is provided with a control valve. The flow rate of cooling medium flowing through the bypass passage can be adjusted through control of the control valve. A cooling circuit for causing cooling medium to circulate is so constructed as to include the control valve, the radiator passage, and the bypass passage.

Further, as a cooling medium passage, there is provided a heat-accumulating passage that has a heat-accumulating container and that can be selectively connected to the cooling circuit. This heat-accumulating passage is connected to the cooling circuit, whereby a heat-accumulating circuit for causing cooling medium in the heat-accumulating container to circulate via the body of the engine is constructed.

In the aforementioned engine cooling device, when the engine is started, hot cooling medium in the heat-accumulating container is caused to flow into the engine by connecting the heat-accumulating passage to the cooling circuit. If the temperature of the cooling medium in the heat-accumulating container becomes lower than a predetermined temperature, the warm-up of the engine is promoted by disconnecting the heat-accumulating passage from the cooling circuit.

Whether cooling medium in the heat-accumulating container is supplied to the engine or the heat-accumulating passage is disconnected from the cooling circuit, the bypass passage is closed to prevent low-temperature cooling medium from being recirculate to the body of the engine. Thus, the warm-up performance of the engine is further enhanced.

In causing cooling medium in the heat-accumulating container to flow into the body of the engine, if cooling medium is caused to circulate with the bypass passage closed as in the case of the aforementioned related art, the following problem may arise.

That is, the flow resistance of cooling medium is increased by closing the bypass passage. Hence, the cooling medium cannot be guaranteed to flow through the cooling circuit and the heat-accumulating circuit at a sufficient flow rate. This results in a delay in warming up the engine.

SUMMARY OF THE INVENTION

An engine cooling device/method capable of suitably promoting the warm-up of an engine is provided as modes of implementing the invention.

This cooling device comprises a cooling circuit, a heat-accumulating passage, and a controller. The cooling circuit is so constructed as to include a radiator passage for causing cooling medium flowing from a body of an engine to flow into the body of the engine via a radiator, a bypass passage for causing cooling medium flowing out from the body of the engine to flow into the body of the engine without flowing via the radiator, and a control valve for controlling a flow rate of cooling medium flowing through the bypass passage. The heat-accumulating passage is provided with a heat-accumulating container for storing the cooling medium in a thermally insulated state, and constitutes a heat-accumulating circuit for causing the cooling medium in the heat-accumulating container to circulate via the body of the engine by being selectively connected to the cooling circuit. The controller i) completes the heat-accumulating circuit by connecting the heat-accumulating passage to the cooling circuit to supply the cooling medium in the heat-accumulating container to the body of the engine and opens the control valve to increase a flow rate of cooling medium flowing through the bypass passage, and then ii) disconnects the heat-accumulating passage from the cooling circuit and closes the control valve.

On the other hand, the engine cooling method comprises a step of causing cooling medium to flow through a cooling circuit that is so constructed as to include a radiator passage for causing cooling medium flowing from a body of an engine to flow into the body of the engine via a radiator, a bypass passage for causing cooling medium flowing out from the body of the engine to flow into the body of the engine without flowing via the radiator, and a control valve for controlling a flow rate of cooling medium flowing through the bypass passage, a step of causing the cooling medium to flow through a heat-accumulating passage that is provided with a heat-accumulating container for storing the cooling medium in a thermally insulated state and that constitutes a heat-accumulating circuit for causing the cooling medium in the heat-accumulating container to circulate via the body of the engine by being selectively connected to the cooling circuit, a step of completing the heat-accumulating circuit by connecting the heat-accumulating passage to the cooling circuit to supply the cooling medium in the heat-accumulating container to the body of the engine and opening the control valve to increase a flow rate of cooling medium flowing through the bypass passage, and a step of disconnecting the heat-accumulating passage from the cooling circuit and closing the control valve after opening the control valve.

According to the aforementioned cooling device and the aforementioned cooling method, when cooling medium in the heat-accumulating container is supplied to the body of the engine, the flow resistance of cooling medium is reduced through an increase in the flow rate of the cooling medium flowing through the bypass passage. Therefore, the flow rate of cooling medium flowing through the cooling circuit and the heat-accumulating circuit is increased. Because the cooling medium in the heat-accumulating container is thereby supplied to the body of the engine at an early stage, the warm-up of the engine can be promoted suitably. After the cooling medium in the heat-accumulating container has been supplied to the body of the engine, the heat-accumulating passage is disconnected from the cooling circuit and the control valve is closed. Therefore, the recalculation of low-temperature cooling medium to the body of the engine is restricted. Thereby, the temperature of the body of the engine can be suitably restrained from falling due to the low-temperature cooling medium.

BRIEF DESCRIPTION OF THE DRAWINGS

The above-mentioned objects, features, advantages, technical and industrial significance of this invention will be better understood by reading the following detailed description of the exemplary embodiments of the invention, when considered in connection with the accompanying drawings, in which:

FIG. 4 shows control patterns of the engine cooling device according to a cooling device cooling process when starting an engine in the embodiment;

DETAILED DESCRIPTION OF EXEMPLARY EMBODIMENTS

In the following description, the invention will be described in more detail in terms of exemplary embodiments.

Figure 1:
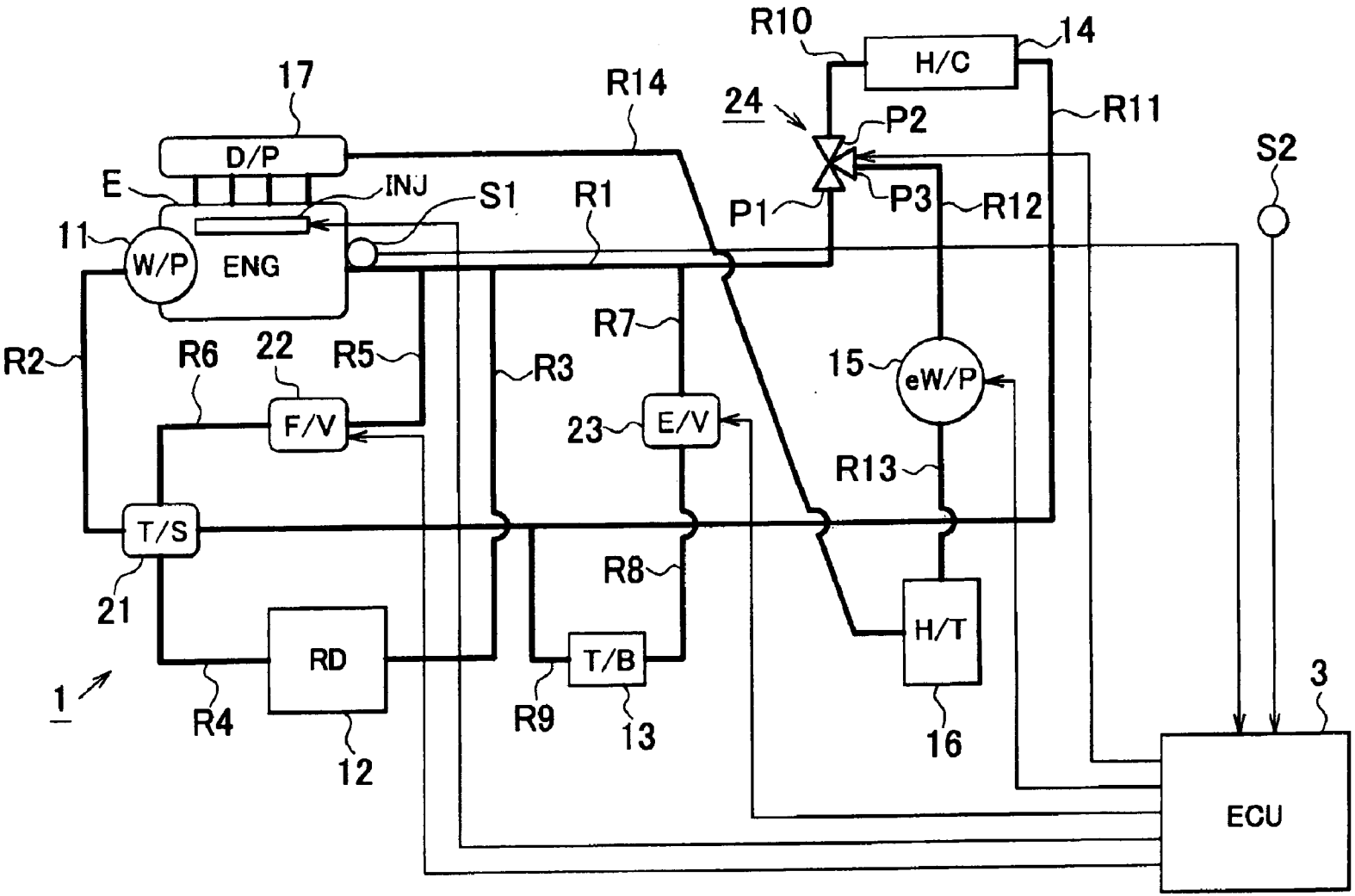
FIG. 1 is a schematic block diagram showing the overall construction of an engine cooling device as a concrete embodiment of the invention.

The overall construction of an engine cooling device having a function of cooling an engine E (engine body) is illustrated in FIG. 1.

First of all, the functions of various components of the engine cooling device 1 will be described. A water pump 11 is driven through the engine E and force-feeds coolant.

A radiator 12 exchanges heat between coolant and outside air.

A throttle body 13 contains a throttle valve and adjusts the amount of intake air in accordance with the opening of the valve.

A heater core 14 exchanges heat between coolant and air for heating the interior of a vehicle compartment. The heat-exchanged air is supplied to the interior of the vehicle compartment through a heater.

An electric water pump 15 is driven through a battery and force-feeds coolant.

A heat-accumulating container 16 stores coolant and thermally insulates the coolant from air outside the container. Thus, the coolant is stored in the heat-accumulating container 16 while being held constant in temperature.

A coolant delivery pipe 17 causes coolant that has flown out from the heat-accumulating container 16 to flow into a cylinder head of the engine E.

A thermostat 21 operates in accordance with the temperature of coolant, and adjusts the flow rate of coolant flowing into a radiator 12. When the thermostat 21 assumes a minimum opening (i.e., when the thermostat 21 is closed), the flow rate of coolant flowing into the radiator 12 is "0". As the opening of the thermostat 21 approaches a maximum opening, the flow rate of coolant flowing into the radiator 12 increases.

A flow rate control valve 22 is continuously variable in opening and adjusts the flow rate of coolant flowing through a flow passage (bypass passage) for causing the coolant to circulate while bypassing the radiator 12. When the flow rate control valve 22 assumes a minimum opening (i.e., when the flow rate control valve 22 is closed), the flow rate of coolant flowing through the flow passage is "0". As the opening of the flow rate control valve 22 approaches a maximum opening, the flow rate of coolant flowing through the flow passage increases.

An open-close valve 23 can be switched to its open or closed state, and changes over the flow pattern of coolant in a flow passage (throttle passage) for causing the coolant to flow into a throttle body 13. When the open-close valve 23 is in its open state, coolant is supplied to the throttle body 13. On the other hand, when the open-close valve 23 is in its closed state, coolant is not supplied to the throttle body 13.

A three-way valve 24 has three ports (i.e., a first port P1, a second port P2, and a third port P3), and selectively changes over the circulation pattern of coolant by changing open-close states among the ports.

An electronic control unit (EMU) 3 comprehensively controls an injector INJ of the engine E, the electric water pump 15, the flow rate control valve 22, the open-close valve 23, and the three-way valve 24. The construction of the controller (control means) includes the EMU 3.

Next, various sensors constituting a detection system of the engine cooling device 1 will be described. Various data detected through the detection system are input to the EMU 3.

An engine coolant temperature sensor S1 detects a temperature (engine coolant temperature The) of coolant for cooling the engine E.

A system switch S2 detects a request to start the engine E. A request to start the engine E can be detected, for example, on the basis of a condition that the changeover position of an ignition switch be shifted to "ON" or a condition that a door be opened through a door open-close switch of the vehicle.

The EMU 3 monitors the amount of fuel injected from the injector IN.

Next, flow passages in the engine cooling device 1 will be described.

A first cooling passage R1 connects the engine E to the first port P1 of the three-way valve 24.

A second cooling passage R2 connects the engine E to the thermostat 21.

A third cooling passage R3 connects the first cooling passage R1 to the radiator 12.

A fourth cooling passage R4 connects the radiator 12 to the thermostat 21.

A fifth cooling passage R5 connects the first cooling passage R1 to the flow rate control valve 22.

A sixth cooling passage R6 connects the flow rate control valve 22 to the second cooling passage R2 via the thermostat 21. The sixth cooling passage R6 is in communication with the second cooling passage R2 whether the thermostat 21 is open or closed.

A seventh cooling passage R7 connects the first cooling passage R1 to the open-close valve 23.

An eighth cooling passage R8 connects the open-close valve 23 to the throttle body 13.

A ninth cooling passage R9 connects the throttle body 13 to the second cooling passage R2 via the thermostat 21. The ninth cooling passage R9 is in communication with the second cooling passage R2 whether the thermostat 21 is open or closed.

A tenth cooling passage R10 connects the second port R2 of the three-way valve 24 to the heater core 14.

An eleventh cooling passage R11 connects the heater core 14 to the second cooling passage R2 via the thermostat 21. The eleventh cooling passage R11 is in communication with the second cooling passage R2 whether the thermostat 21 is open or closed.

A twelfth cooling passage R12 connects the third port P3 of the three-way valve 24 to the electric water pump 15.

A thirteenth cooling passage R13 connects the electric water pump 15 to the heat-accumulating container 16.

A fourteenth cooling passage R14 connects the heat-accumulating container 16 to the coolant delivery pipe 17.

The following cooling passages are constituted through the aforementioned cooling passages respectively.

The third cooling passage R3 and the fourth cooling passage R4 constitute a radiator passage. When the thermostat 21 is open, the radiator passage is open. On the other hand, when the thermostat 21 is closed, the radiator passage is closed. When the radiator passage is open, coolant flows via the radiator 12.

The fifth cooling passage R5 and the sixth cooling passage R6 onstitute a bypass passage. When the flow rate control valve 22 is open, the bypass passage is open. On the other hand, when the flow rate control valve 22 is closed, the bypass passage is closed. When the bypass passage is open, coolant flows while bypassing the radiator 12.

The seventh cooling passage R7, the eighth cooling passage R8, and the ninth cooling passage R9 constitute a throttle passage. When the open-close valve 23 is open, the throttle passage is open. On the other hand, when the open-close valve 23 is closed, the throttle passage is closed. When the throttle passage is open, coolant flows via the throttle body 13.

The tenth cooling passage R10 and the eleventh passage R11 constitute a heater passage. The heater passage can be selectively connected to the first cooling passage R1 through control of the three-way valve 24. When both the first and second ports P1 and P2 of the three-way valve 24 are open, the heater passage is connected to the first cooling passage R1 (the heater passage is opened). On the other hand, when the first or second port P1 or P2 of the three-way valve 24 is closed, the heater passage is disconnected from the first cooling passage R1 (the heater passage is closed). When the heater passage is open, coolant flows via the heater core 14.

The twelfth cooling passage R12, the thirteenth cooling passage R13, and the fourteenth cooling passage R14 constitute a heat-accumulating passage. The heat-accumulating passage can be selectively connected to the first cooling passage R1 through control of the three-way valve 24. When both the first and third ports P1 and P3 of the three-way valve 24 are open, the heat-accumulating passage is connected to the first cooling passage R1 (the heat-accumulating passage is opened). On the other hand, when the first or third port P1 or P3 of the three-way valve 24 is closed, the heat-accumulating passage is disconnected from the first cooling passage R1 (the heat-accumulating passage is closed). When the heat-accumulating passage is open, coolant flows via the heat-accumulating container 16.

The following circulation circuits for causing coolant to circulate are constituted by the aforementioned respective cooling passages.

The first cooling passage R1, the second cooling passage R2, the radiator passage (the third cooling passage R3 and the fourth cooling passage R4), the bypass passage (the fifth cooling passage R5 and the sixth cooling passage R6), the throttle passage (the seventh cooling passage R7, the eighth cooling passage R8, and the ninth cooling passage R9), and the heater passage (the tenth cooling passage R10 and the eleventh cooling passage R11) constitute a cooling circuit.

When coolant circulates through the radiator passage, heat is exchanged in the radiator 12 between the coolant and outside air. When coolant circulates through the bypass passage, radiation of heat from the coolant in the radiator 12 is restricted. When coolant circulates through the throttle passage, heat is exchanged between the throttle body 13 and the coolant. When coolant circulates through the heater passage, heat is exchanged in the heater core 14 between the coolant and air for heating the vehicle compartment.

The first cooling passage R1 and the heat-accumulating passage (the twelfth cooling passage R12, the thirteenth cooling passage R13, and the fourteenth cooling passage R14) constitute a heat-accumulating circuit. The heat-accumulating passage is connected to the cooling circuit (the first cooling passage R1) through control of the three-way valve 24, whereby the heat-accumulating circuit is constituted.

When coolant circulates through the heat-accumulating circuit, heat is exchanged between the coolant stored in the heat-accumulating container 16 and the engine E. When the open-close valve 23 is open, heat is further exchanged between the coolant stored in the heat-accumulating container 16 and the throttle body 13. When both the first and second ports P1 and P2 of the three-way valve 24 are open, heat is further exchanged in the heater core 14 between the coolant stored in the heat-accumulating container 16 and air for heating the vehicle compartment.

In the engine cooling device 1 thus constructed, when the engine E is started, the heat-accumulating passage is opened to supply the engine E with coolant in the heat-accumulating container 16, whereby the warm-up of the engine E can be promoted.

If coolant is caused to circulate with the bypass passage closed in causing coolant in the heat-accumulating container to flow into the engine, the flow resistance of the coolant increases, so that the flow rate of coolant flowing through the cooling circuit and the heat-accumulating circuit is not guaranteed to be sufficient. Hence, the performance of warm-up is adversely affected.

In the present embodiment, therefore, such apprehensions are dispelled by controlling the engine cooling device through a procedure that will be described below.

Hereinafter, "a cooling device control process during start of the engine" for controlling the driving pattern of the engine cooling device during start of the engine will be described with reference to FIGS. 2 and 3. This process is composed of "a preheat process" shown in FIG. 2 and "a coolant circulation stoppage process" shown in FIG. 3. It is to be noted herein that the present process corresponds to the process performed through the control means of the invention.

Figure 2:
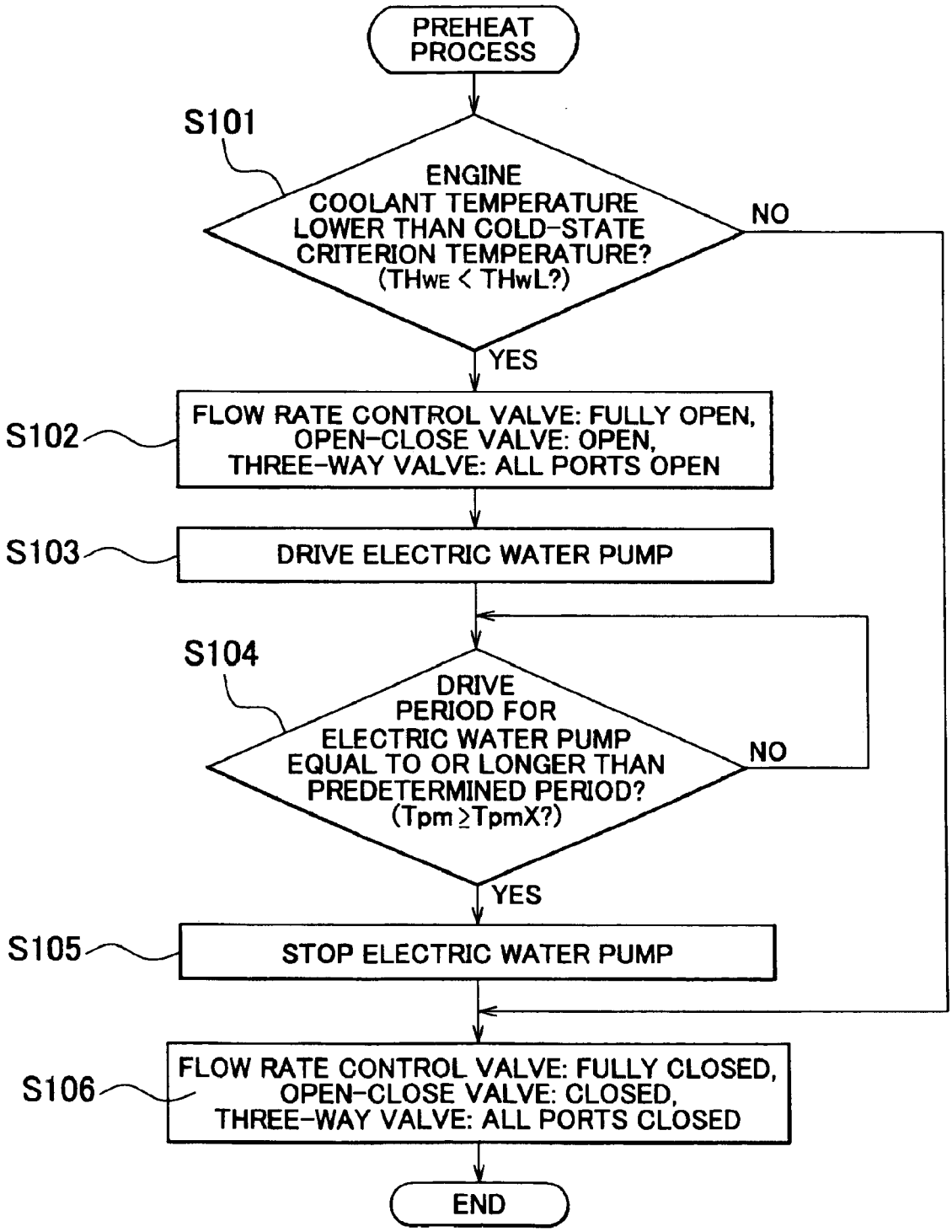
FIG. 2 is a flowchart showing a preheat process performed in the embodiment.

Referring to FIG. 2, "the preheat process" will be described. This process is started upon detection of a request to start the engine E through the system switch S2, and is terminated after the performance of processing in steps S101 to S106 which will be described below.

It is determined whether or not an engine coolant temperature THwe is lower than a cold-state criterion temperature THwL (step S101). That is, it is determined whether or not a condition THwe <THwL is satisfied.

If the engine coolant temperature THwe is equal to or higher than the cold-state criterion temperature THwL, a shift to step S106 is made without performing the processing in the following steps S102 to S105. The cold-state criterion temperature THwL is used as a coolant temperature threshold indicating whether or not the engine E is in a cold state. That is, if the engine coolant temperature THwe is lower than the cold-state criterion temperature THwL, the engine E is in a cold state.

If the engine coolant temperature THwe is lower than the cold-state criterion temperature THwL, the following operations are performed (step S102).

Namely, (a) the bypass passage is opened by fully opening the flow rate control valve 22 (i.e., by setting the opening thereof as a maximum opening), (b) the throttle passage is opened by opening the open-close valve 23, (c) the heater passage is connected to the first cooling passage R1 by opening the first and second ports P1 and P2 of the three-way valve 24, and (d) the heat-accumulating passage is connected to the first cooling passage R1 by opening the first and third ports P1 and P3 of the three-way valve 24.

Coolant is caused to circulate through the bypass passage, the throttle passage, the heater passage, and the heat-accumulating passage by driving the electric water pump 15 (step S103). The promotion of warm-up of the engine E through hot coolant (hot fluid) stored in the heat-accumulating container 16, namely, so-called preheat is thereby realized.

It is determined whether or not a drive period Tpm for the electric warm pump 15 is equal to or longer than a predetermined period TpmX (step S104). That is, it is determined whether or not a condition Tpm ≧TpmX is satisfied. If the condition is not satisfied, the processing in the aforementioned step S104 is repeatedly performed. The predetermined drive period TpmX indicates a period that elapses before the hot coolant stored in the heat-accumulating container 16 is sufficiently supplied to the interior of the engine E, and can be set in accordance with the volume of the heat-accumulating container 16 or the size of the engine E.

If the drive period Tpm for the electric water pump 15 has become equal to or longer than the predetermined period TpmX (i.e., if preheat has been completed), the electric water pump 15 is stopped (step S105). The circulation of coolant in the engine cooling device 1 is thereby stopped.

In step S106, the following operations are performed.

Namely, (a) the bypass passage is closed by fully closing the flow rate control valve 22 (i.e., by setting the opening thereof as a minimum opening), (b) the throttle passage is closed by closing the open-close valve 23, (c) the heater passage is disconnected from the first cooling passage R1 by closing the first and second ports P1 and P2 of the three-way valve 24, and (d) the heat-accumulating passage is disconnected from the first cooling passage R1 by closing the first and third ports P1 and P3 of the three-way valve 24. The present process is terminated after the aforementioned operations have been completed.

Thus, according to the preheat process, when the engine E is started in a cold state (i.e., during cold start of the engine E), hot fluid in the heat-accumulating container 16 is supplied to the engine E while the flow rate control valve 22, the open-close valve 23, and the three-way valve 24 are all open. In other words, during cold start of the engine E, preheat is carried out after all the valves that can be controlled through the EMU 3 have been opened.

If the hot fluid stored in the heat-accumulating container 16 has sufficiently been supplied to the interior of the engine E and if the engine E has been warmed up in comparison with a cold state during start thereof (i.e., during warm start of the engine E), the respective cooling passages of the engine cooling device 1 are closed to stop the circulation of coolant.

Figure 3:
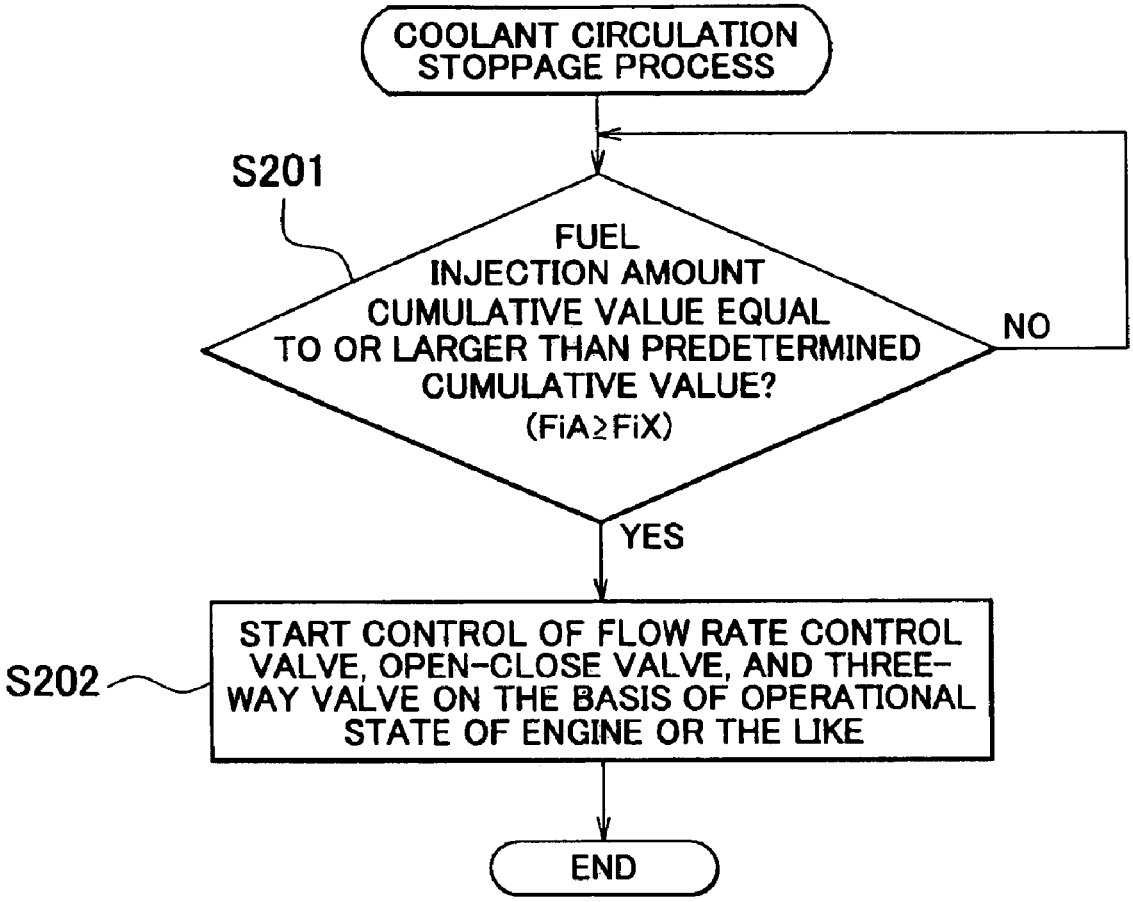
FIG. 3 is a flowchart showing a coolant circulation stoppage process performed in the embodiment.

Referring to FIG. 3, the coolant circulation stoppage process will be described. This process is started upon start of the engine E, and is terminated after the performance of processing in steps S201 and S202 which will be described below.

It is determined whether or not a cumulative value of fuel injection amounts from the start of the engine E up to now (a fuel injection amount cumulative value FiA) is equal to or larger than a predetermined cumulative value FiX (step S201). That is, it is determined whether or not a condition FiA ≧FiX is satisfied. The predetermined cumulative value FiX is used as a fuel injection amount threshold cumulative value indicating whether or not the engine E has just been started. Namely, if the injection amount cumulative value is smaller than the predetermined cumulative value FiX, the engine E has just been started.

If the engine E has just been started (i.e., if the injection amount cumulative value FiA is smaller than the predetermined cumulative value FiX), the processing in the aforementioned step S201 of determination is repeatedly performed at intervals of a predetermined period. At this moment, the flow rate control valve 22, the open-close valve 23, and the three-way valve 24 are controlled according to the following pattern. Namely, (a) the flow rate control valve 22 is held fully closed, (b) the open-close valve 23 is held closed, (c) the first and second ports P1 and P2 of the three-way valve 24 are held closed, and (d) the first and third ports P1 and P3 of the three-way valve 24 are held closed.

If the injection amount cumulative value FiA has become equal to or larger than the predetermined cumulative value FiX, the engine cooling device 1 is restored to normal control (step S202). That is, the flow rate control valve 22, the open-close valve 23, and the three-way valve 24 are controlled in accordance with the operational state of the engine E or the like.

Thus, according to the coolant circulation stoppage process, before the injection amount cumulative value FiA becomes equal to or larger than the predetermined cumulative value FiX after the engine E has been started, the flow rate control valve 22, the open-close valve 23, and the three-way valve 24 are held closed, whereby the circulation of coolant in the engine cooling device 1 is stopped.

Referring now to FIG. 4, the control patterns of the engine cooling device 1 according to the cooling device control process (FIGS. 2 and 3) during start of the engine will be summarized.

If a condition [1] shown below is satisfied in starting the engine E, the engine cooling device 1 is controlled through a preheat mode that will be described later. On the other hand, if one of conditions [2] to [4] shown below is satisfied in starting the engine E, the engine cooling device 1 is controlled through a coolant circulation stoppage mode that will be described later.

[1] That the engine E be started in a cold state (the engine coolant temperature The be lower than the cold-state criterion temperature THwL) and that preheat have not been completed (the drive period Tpm for the electric water pump 15 be shorter than the predetermined period TpmX).

[2] That the engine E be started in a cold state (the engine coolant temperature The be lower than the cold-state criterion temperature THwL) and that preheat have been completed (the drive period Tpm for the electric water pump 15 be equal to or longer than the predetermined period TpmX).

[3] That the engine E be started in a hot state (the engine coolant temperature The be equal to or higher than the cold-state criterion temperature THwL).

[4] That the engine E have just been started (the fuel injection amount cumulative value FiA be smaller than the predetermined cumulative value FiX).

In the preheat mode, (a) the flow rate control valve 22 is fully opened, (b) the open-close valve 23 is opened, (c) all the ports of the three-way valve 24 are opened, and (d) the electric water pump 15 is driven. The engine cooling device 1 is controlled according to these patterns.

In the coolant circulation stoppage mode, (a) the electric water pump 15 is stopped, (b) the flow rate control valve 22 is fully closed, (c) the open-close valve 23 is closed, and (d) all the ports of the three-way valve 24 are closed. The engine cooling device 1 is controlled according to these patterns.

In any of the aforementioned respective control modes, the thermostat 21 is basically held closed.

Figure 5:
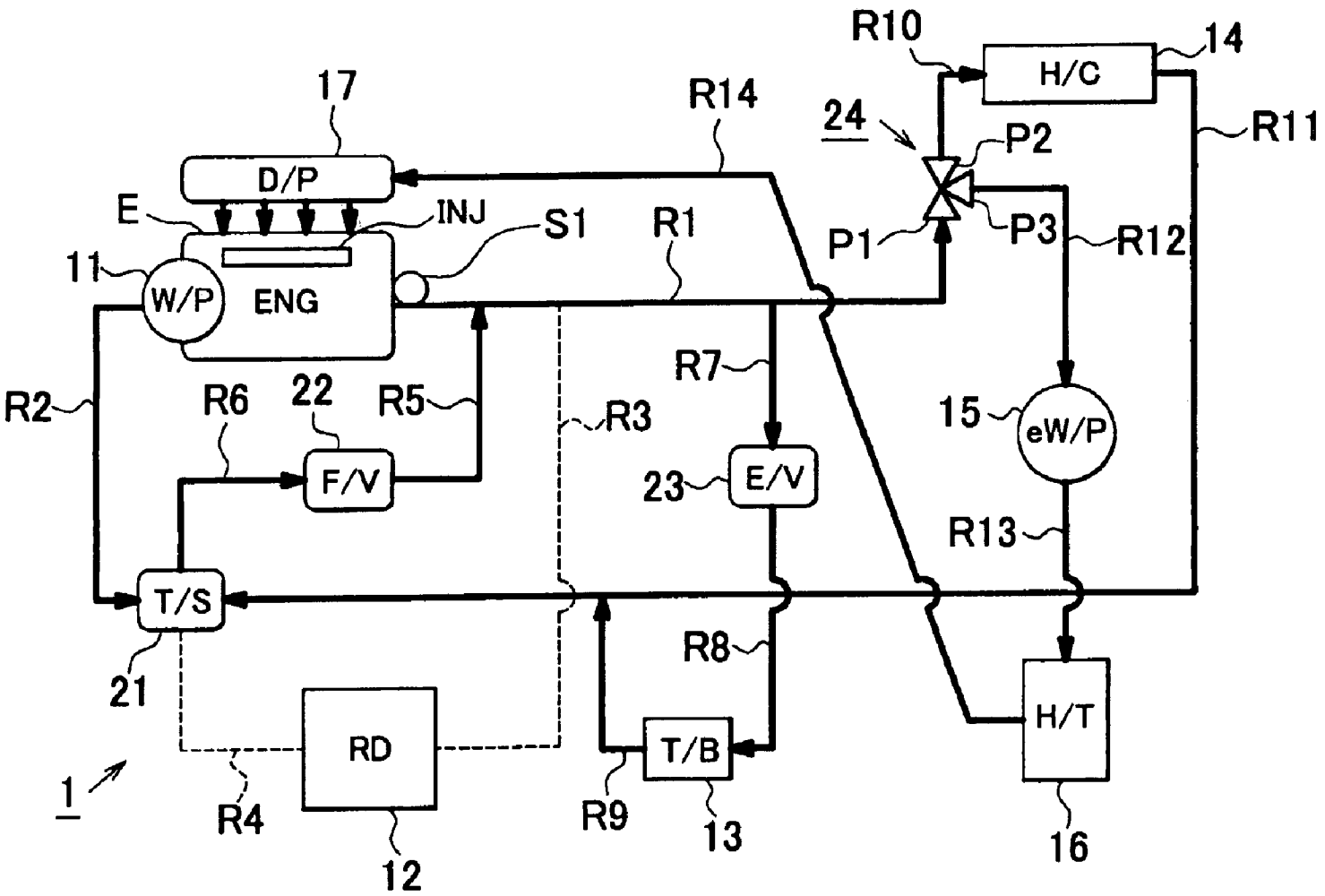
FIG. 5 is a block diagram of a circulation pattern of coolant during a preheat mode in the engine cooling device of the embodiment.
Figure 6:
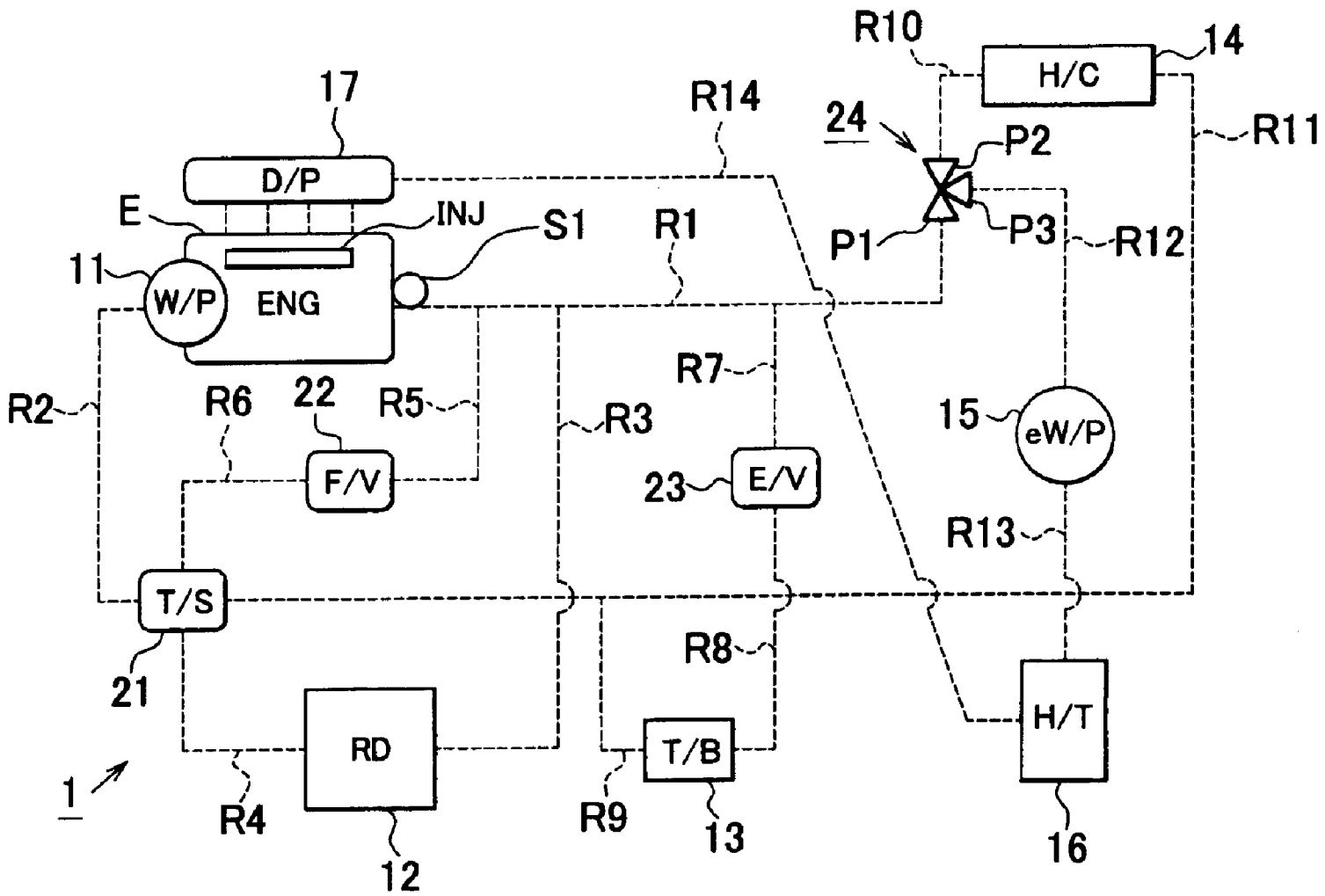
FIG. 6 is a block diagram of a circulation pattern of coolant during a coolant circulation stoppage mode in the engine cooling device of the embodiment.

Referring now to FIGS. 5 and 6, the operation and effect achieved by "the cooling device control process during start of the engine" (FIGS. 2 and 3) will be described. FIG. 5 shows a pattern according to which coolant circulates when the engine cooling device 1 is controlled through the preheat mode. FIG. 6 shows a pattern according to which coolant circulates when the engine cooling device 1 is controlled through the coolant circulation stoppage mode. In FIGS. 5 and 6, cooling passages indicated by solid lines represent those through which coolant flows, arrows represent directions in which coolant flows, and cooling passages indicated by broken lines represent those through which coolant does not flow.

Referring to FIG. 5, the operation and effect achieved by the preheat mode will be described.

When the engine cooling device 1 is controlled through the preheat mode, the electric water pump 15 causes coolant to circulate while the bypass passage, the throttle passage, and the heater passage as well as the heat-accumulating passage are open. Therefore, the coolant flows through all the cooling passages but the radiator passage.

At this moment, since coolant circulates via the heat-accumulating passage, the hot fluid stored in the heat-accumulating container 16 is supplied to the engine E. Also, because the bypass passage, the throttle passage, and the heater passage are open, the flow resistance of coolant is reduced.

The flow rate of the hot fluid supplied to the engine E from the heat-accumulating container 16 thereby increases, and the hot fluid in the heat-accumulating container 16 flows into the engine E at an early stage. Therefore, the warm-up of the engine E is promoted suitably.

Referring to FIG. 6, the operation and effect achieved by the coolant circulation stoppage mode will be described.

When the engine cooling device 1 is controlled through the coolant circulation stoppage mode, the radiator passage, the bypass passage, the throttle passage, the heater passage, and the heat-accumulating passage are closed. Therefore, coolant does not circulate through any of the cooling passages.

Thus, after hot fluid in the heat-accumulating container 16 has been supplied into the interior of the engine E sufficiently, low-temperature coolant is not recirculate to the engine E. Therefore, the warm-up of the engine E is promoted more suitably.

When the engine E is started in a hot state and even if the engine E has just been started, low-temperature coolant is not recirculate to the engine E. Therefore, the warm-up of the engine E is promoted more suitably.

Figures 7A, 7B, 7C, 7D, 7E, 7F:
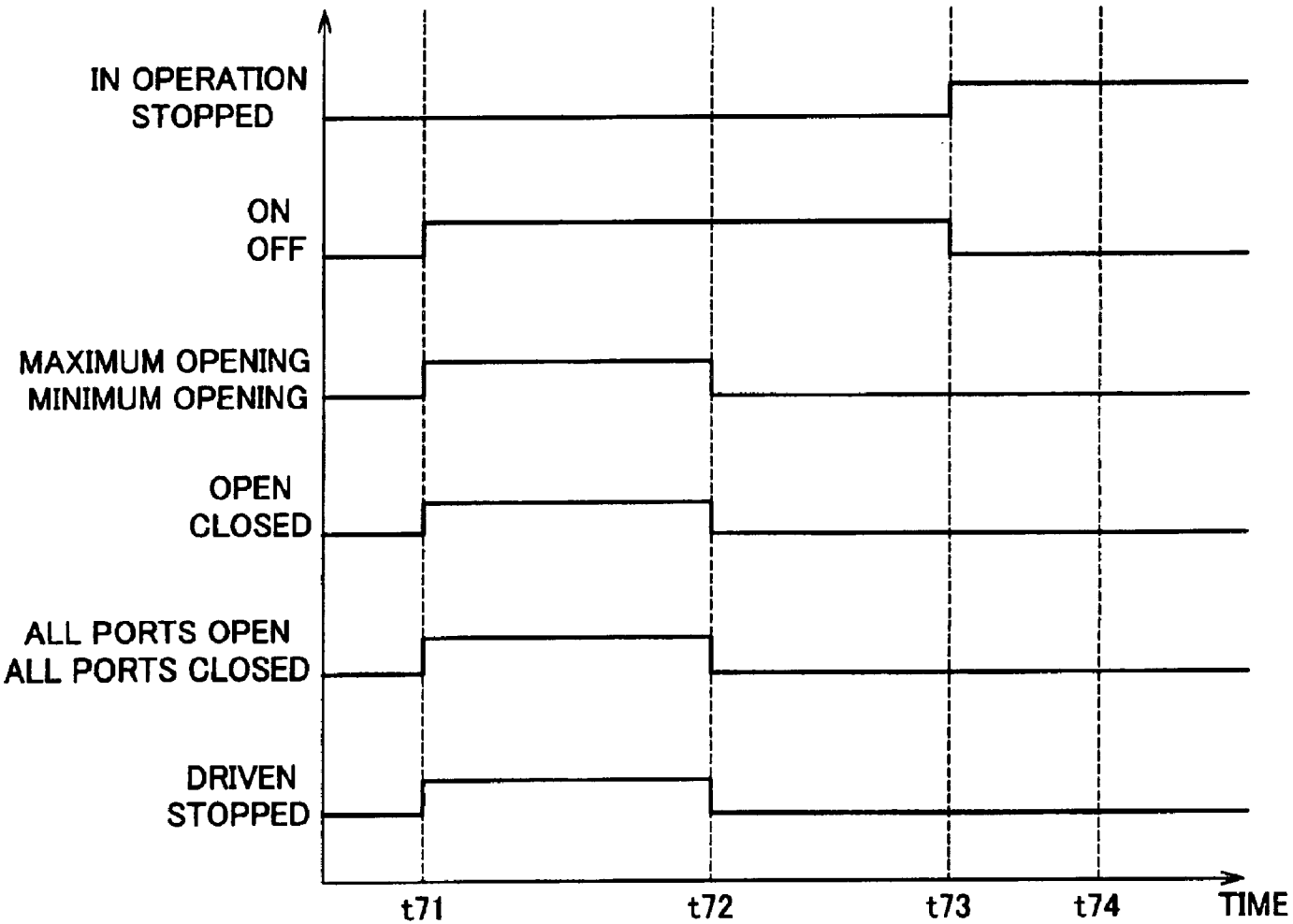
FIG. 7A is a timing chart showing a control pattern that is realized as to operation/stoppage of the engine by a cooling device control process during start of the engine.
FIG. 7B is a timing chart showing a control pattern that is realized as to the presence of an engine start request by the cooling device control process during the start of the engine.
FIG. 7C is a timing chart showing a control pattern that is realized as to the opening of a flow rate control valve by the cooling device control process during the start of the engine.
FIG. 7D is a timing chart showing a control pattern that is realized as to the opening/closing of an open-close valve by the cooling device control process during the start of the engine.
FIG. 7E is a timing chart showing a control pattern that is realized as to the opening/closing of all ports of a three-way valve by the cooling device control process during the start of the engine.
FIG. 7F is a timing chart showing a control pattern that is realized as to the drive/stoppage of an electric water pump by the cooling device control process during the start of the engine.

Referring now to FIG. 7, one example of the control pattern of the engine cooling device 1 according to "the cooling device control process during start of the engine" will be described. It is assumed that a request to start the engine E is detected through a vehicle-door opening operation based on a door open-close switch at a time t71 (see FIG. 7B).

If it is assumed herein that the engine coolant temperature THwe is lower than the cold-state criterion temperature THwL, the following operations (a) to (d) are performed (see FIGS. 7C to 7F).

That is, (a) the flow rate control valve 22 is fully opened, (b) the open-close valve 23 is fully opened, (c) all the ports of the three-way valve 24 are opened, and (d) the electric water pump 15 is driven.

Coolant is thereby caused to circulate with its flow resistance having been reduced. As a result, the hot fluid in the heat-accumulating container 16 is supplied to the engine E at an early stage.

If it is assumed that the drive period Tpm for the electric water pump 15 becomes equal to or longer than the predetermined period TpmX at a time t72, the following operations (a) to (d) are performed (see FIGS. 7C to 7F).

That is, (a) the electric water pump 15 is stopped, (b) the flow rate control valve 22 is fully closed, (c) the open-close valve 23 is fully closed, and (d) all the ports of the three-way valve 24 are closed.

The circulation of low-temperature coolant to the engine E is thereby stopped. As a result, the warm-up of the engine E is promoted suitably.

If it is assumed that the engine E is started at a time t73, the flow rate control valve 22, the open-close valve 23, and the three-way valve 24 are held closed until the fuel injection amount cumulative value FiA becomes equal to or larger than the predetermined cumulative value FiX (see FIGS. 7A and 7C to 7E).

Because the circulation of coolant is thereby stopped, the warm-up of the engine E is promoted suitably.

If it is assumed that the fuel injection amount cumulative FiA becomes equal to or larger than the predetermined cumulative value FiX at a time t74, the flow rate control valve 22, the open-close valve 23, and the three-way valve 24 are thereafter controlled in accordance with the operational state of the engine E (FIGS. 7C to 7E).

As described above in detail, beneficial effects as cited below are gained from the engine cooling device of the embodiment.

(1) In the present embodiment, if hot fluid in the heat-accumulating container 16 is supplied to the engine E on the ground that the engine coolant temperature The is lower than the cold-state criterion temperature THwL before the operation of starting the engine E, the bypass passage, the throttle passage, and the heater passage as well as the heat-accumulating passage are opened. The flow resistance of coolant is thereby reduced, and the hot fluid in the heat-accumulating container 16 is supplied to the engine E at an early stage. Therefore, the warm-up of the engine E can be promoted suitably.

(2) The aforementioned process (1) is performed before the operation of starting the engine E. Therefore, the engine E can be warmed up at an earlier stage.

(3) In the present embodiment, if hot fluid in the heat-accumulating container 16 is sufficiently supplied to the engine E before the operation of starting the engine E, the bypass passage, the throttle passage, the heater passage, and the heat-accumulating passage are closed. The circulation of low-temperature coolant to the engine E is thereby stopped. Therefore, the engine E can be suitably restrained from being lowered in temperature by low-temperature coolant.

(4) In the present embodiment, if the engine coolant temperature The is equal to or higher than the cold-state criterion temperature THwL before the operation of starting the engine E, the bypass passage, the throttle passage, the heater passage, and the heat-accumulating passage are closed. The circulation of low-temperature coolant is thereby stopped. Therefore, the engine E can be suitably restrained from being lowered in temperature by low-temperature coolant.

(5) In the present embodiment, before the fuel injection amount cumulative value FiA becomes equal to or larger than the predetermined cumulative value FiX after the engine E has been started, the warm-up operation of the engine E is performed with the bypass passage, the throttle passage, the heater passage, and the throttle passage being closed. The circulation of coolant is thereby stopped. Therefore, the warm-up of the engine E can be promoted suitably.

The aforementioned embodiment may be suitably modified and can also be implemented as embodiments that will be described hereinafter.

In the aforementioned embodiment, the following determination process can also be added to the preheat process (FIG. 2). That is, it is determined immediately before or after step S101 "whether or not the temperature of coolant in the heat-accumulating container 16 (i.e., a heat-accumulating container coolant temperature THwt) is equal to or higher than a predetermined criterion temperature". In this case, (a) if the heat-accumulating container coolant temperature THwt is equal to or higher than the predetermined criterion temperature, the processing starting from step S102 are sequentially performed. On the other hand, (b) if the heat-accumulating container coolant temperature THwt is lower than the predetermined criterion temperature, the processing in step S106 is performed while omitting the processing in steps S102 to S105. The construction as described herein makes it possible to appropriately promote the warm-up of the engine E.

In the aforementioned embodiment, the following determination processing can also be added to the preheat process (FIG. 2). That is, it is determined immediately before or after step S101 "whether or not the temperature of coolant in the heat-accumulating container 16 (i.e., the heat-accumulating container coolant temperature THwt) is equal to or higher than the engine coolant temperature THwe". In this case, (a) if the heat-accumulating container coolant temperature THwt is equal to or higher than the engine coolant temperature THwe, the processing starting from step S102 are sequentially performed. On the other hand, (b) if the heat-accumulating container coolant temperature THwt is lower than the engine coolant temperature THwe, the processing in step S106 is performed while omitting the processing in steps S102 to S105. The construction as described herein prevents the low-temperature coolant stored in the heat-accumulating container 16 from being supplied to the engine E. As a result, the warm-up performance of the engine E can be suitably restrained from deteriorating.

In the aforementioned embodiment, it is determined whether or not the engine coolant temperature The is lower than the cold-state criterion temperature THwL, and the processing in steps S102 to S105 (preheat) are performed when this condition is satisfied. However, the invention is not limited to this construction. Namely, it is also appropriate to omit the determination processing in step S101 and to perform the processing starting from step S102 every time the engine E is started. The construction as described herein eliminates the necessity to monitor the engine coolant temperature THwe prior to the implementation of preheat. In consequence, the preheat process is simplified.

In the aforementioned embodiment, preheat is carried out on the ground that the engine coolant temperature THwe is lower than the cold-state criterion temperature THwL. However, the invention is not limited to this construction. Namely, preheat may also be carried out on the ground that the engine coolant temperature THwe is lower than an outside air temperature.

In the aforementioned embodiment, the cold-state criterion temperature THwL is used in the determination processing of step S101. However, the cold-state criterion temperature THwL can be suitably changed to any temperature "that is equal to or higher than an outside air temperature and that is lower than a coolant temperature indicating the completion of warm-up of the engine E".

In the aforementioned embodiment, it is determined that the engine E has just been started, on the ground that the fuel injection amount cumulative value FiA is smaller than the predetermined cumulative value FiX. However, the invention is not limited to this construction. Namely, it may also be determined that the engine E has just been started on the ground that the engine coolant temperature THwe is lower than the predetermined temperature.

In the aforementioned embodiment, it is determined that the engine E has just been started, on the ground that the fuel injection amount cumulative value FiA is smaller than the predetermined cumulative value FiX. However, the invention is not limited to this construction. Namely, it may also be determined that the engine E has just been started, on the ground that the elapsed time after completion of the start of the engine E is shorter than a predetermined elapsed time.

In the aforementioned embodiment, a request to start the engine E can be detected on the basis of the condition that "the changeover position of the ignition switch be shifted to "ON"" or the condition that "the door be opened through the door open-close switch of the vehicle". However, the detection of a request to start the engine can be determined on the basis of other suitable conditions as well as the conditions exemplified in the aforementioned embodiment. For instance, a request to start the engine may also be detected on the basis of a condition "that the changeover position of the ignition switch be shifted to "START"".

In the aforementioned embodiment, the open-close valve 23 is opened to open the throttle passage if preheat has not been completed in starting the engine E in a cold state. However, the invention is not limited to this construction. Namely, the open-close valve 23 is closed even if preheat has not been completed in starting the engine E in a cold state. It is also appropriate that the throttle valve be thereby closed.

In the aforementioned embodiment, if preheat has not been completed in starting the engine E in a cold state, the flow rate control valve 22 is fully opened to open the bypass passage. However, the invention is not limited to this construction. Namely, if preheat has not been completed in starting the engine E in a cold state, the flow rate control valve 22 may also be set at any opening between its maximum opening and its minimum opening to open the bypass passage. In short, the control pattern of the flow rate control valve can be suitably changed as long as the flow rate of coolant flowing through the bypass passage is increased when the coolant is caused to circulate through the heat-accumulating circuit in starting the engine E in a cold state.

In the aforementioned embodiment, if preheat has not been completed in starting the engine E in a cold state, the first and second ports P1 and P2 of the three-way valve 24 are opened to open the heater passage. However, the invention is not limited to this construction. The heater passage may also be closed by closing the second port P2 of the three-way valve 24 if preheat has not been completed in starting the engine E in a cold state.

In the aforementioned embodiment, the thermostat 21 that operates in accordance with the temperature of coolant is used. However, the invention is not limited to this construction. It is also possible to employ an electronic thermostat capable of electrically controlling the release state of a valve. In the construction as described herein, the electronic thermostat is opened to open the radiator passage if preheat has not been completed in starting the engine E in a cold state, whereby the flow resistance of coolant can further be reduced. If any one of the above-mentioned conditions (2) to (4) is satisfied, the recalculation of low-temperature coolant to the engine E can be avoided by closing the electronic thermostat.

In the aforementioned embodiment, the throttle passage is provided with the open-close valve 23. However, the invention is not limited to this construction. Namely, a flow rate control valve whose opening is continuously variable can also be provided in place of the open-close valve 23.

In the aforementioned embodiment, the bypass passage is provided with the flow rate control valve 22. However, the invention is not limited to this construction. Namely, an open-close valve that can be switched to either its open state or its closed state can also be provided in place of the flow rate control valve 22.

In the aforementioned embodiment, the preheat process is started in response to a request to start the engine E. However, the invention is not limited to this construction. Namely, the preheat process may also be started in response to the start of the engine E. The construction as described herein makes it possible to start the coolant circulation stoppage process after the preheat process has been completed.

In the aforementioned embodiment, the preheat process is started in response to a request to start the engine E. However, the invention is not limited to this construction. The preheat process may also be started immediately after the engine E has been started. The construction as described herein makes it possible to start the coolant circulation stoppage process after the preheat process has been completed.

In the aforementioned embodiment, the heat-accumulating passage is connected to or disconnected from the cooling circuit through control of the three-way valve 24. However, the invention is not limited to this construction. Namely, it is also appropriate that the heat-accumulating passage be provided with an open-close valve, a flow rate control valve or the like and be connected to or disconnected from the cooling circuit through control of the open-close valve, the flow rate control valve or the like.

In the aforementioned embodiment, the invention is embodied on the assumption that the engine cooling device 1 exemplified in FIG. 1 is to be used. However, the construction of the engine cooling device is not limited to the construction exemplified in the embodiment but can be any suitable construction. In short, as long as the cooling device is provided with a cooling circuit composed of a radiator passage, a bypass passage, and a flow rate control valve for controlling the flow rate of coolant flowing through the bypass passage, and with a heat-accumulating passage that includes a heat-accumulating container and that constitutes a heat-accumulating circuit by being selectively connected to the cooling circuit, it is possible to provide the cooling device with any construction.

In the aforementioned embodiment, the engine cooling device 1 is controlled during start of the engine E through the cooling device control process performed in starting the engine. However, the cooling device control process performed in starting the engine is not limited to the construction exemplified in the embodiment. In short, the control pattern can be suitably modified as long as it is constructed such that a heat-accumulating circuit is completed by connecting a heat-accumulating passage to a cooling circuit in starting an engine, that a bypass passage is opened through control of a control valve, that the heat-accumulating passage is disconnected from the cooling circuit after coolant in a heat-accumulating container has been supplied to the engine, and that the bypass passage is closed through control of the control valve.

While the invention has been described with reference to the exemplary embodiments thereof, it is to be understood that the invention is not limited to the exemplary embodiments or constructions. To the contrary, the invention is intended to cover various modifications and equivalent arrangements. In addition, while the various elements of the exemplary embodiments are shown in various combinations and configurations, which are exemplary, other combinations and configurations, including more, less or only a single element, are also within the spirit and scope of the invention.

What is claimed is:

1. An engine cooling device comprising:

a cooling circuit that is so constructed as to include a radiator passage for causing cooling medium flowing from a body of an engine to flow into the body of the engine via a radiator, a bypass passage for causing cooling medium flowing out from the body of the engine to flow into the body of the engine without flowing via the radiator, and a control valve for controlling a flow rate of cooling medium flowing through the bypass passage;

a heat-accumulating passage that is provided with a heat-accumulating container for storing the cooling medium in a thermally insulated state and that constitutes a heat-accumulating circuit for causing the cooling medium in the heat-accumulating container to circulate via the body of the engine by being selectively connected to the cooling circuit; and a controller that i) completes the heat-accumulating circuit by connecting the heat-accumulating passage to the cooling circuit to supply the cooling medium in the heat-accumulating container to the body of the engine and opens the control valve to increase a flow rate of cooling medium flowing through the bypass passage, and then ii) disconnects the heat-accumulating passage from the cooling circuit and that closes the control valve.

2. The cooling device according to claim 1, wherein the cooling circuit is so constructed as to further include a throttle passage for causing cooling medium flowing out from the body of the engine to flow into the body of the engine via a throttle body, and a throttle open-close valve for opening and closing the throttle passage, and the controller opens the throttle open-close valve in supplying cooling medium in the heat-accumulating container to the body of the engine through the heat-accumulating circuit by connecting the heat-accumulating passage to the cooling circuit, and closes the throttle open-close valve in disconnecting the heat-accumulating passage from the cooling circuit.

3. The cooling device according to claim 1, wherein the cooling circuit is so constructed as to further include a heater passage for causing cooling medium flowing out from the body of the engine to flow into the body of the engine via a heater core, and a heater open-close valve for opening and closing the heater passage, and the controller opens the heater open-close valve in supplying cooling medium in the heat-accumulating container to the body of the engine through the heat-accumulating circuit by connecting the heat-accumulating passage to the cooling circuit, and closes the heater open-close valve in disconnecting the heat-accumulating passage from the cooling circuit.

4. The cooling device according to claim 3, wherein the cooling circuit is so constructed as to further include a throttle passage for causing cooling medium flowing out from the body of the engine to flow into the body of the engine via a throttle body, and a throttle open-close valve for opening and closing the throttle passage, and the controller opens the throttle open-close valve in supplying the cooling medium in the heat-accumulating container to the body of the engine by connecting the heat-accumulating passage to the cooling circuit, and closes the throttle open-close valve in disconnecting the heat-accumulating passage from the cooling circuit.

5. The cooling device according to claim 1, wherein the controller prohibits the heat-accumulating passage from being connected to the cooling circuit if cooling medium in the heat-accumulating container is at a temperature lower than a predetermined temperature.

6. The cooling device according to claim 5, wherein the predetermined temperature is a temperature of coolant for cooling the body of the engine.

7. The cooling device according to claim 1, wherein the controller connects the heat-accumulating passage to the cooling circuit if cooling medium for cooling the body of the engine is at a temperature lower than a predetermined temperature.

8. The cooling device according to claim 7, wherein the predetermined temperature is a cold-state criterion temperature.

9. The cooling device according to claim 7, wherein the predetermined temperature is an outside air temperature.

10. The cooling device according to claim 1, wherein the controller closes the radiator passage both in opening the control valve and in closing the control valve.

11. The cooling device according to claim 1, wherein the controller i) completes the heat-accumulating circuit by connecting the heat-accumulating passage to the cooling circuit and opens the control valve prior to an operation of starting the engine, and ii) disconnects the heat-accumulating passage from the cooling circuit and closes the control valve immediately after the engine has been started.

12. The cooling device according to claim 11, wherein the cooling circuit is so constructed as to further include a throttle passage for causing cooling medium flowing out from the body of the engine to flow into the body of the engine via a throttle body, and a throttle open-close valve for opening and closing the throttle passage, and the controller opens the throttle open-close valve in supplying cooling medium in the heat-accumulating container to the body of the engine by connecting the heat-accumulating passage to the cooling circuit, and closes the throttle open-close valve in disconnecting the heat-accumulating passage from the cooling circuit.

13. The cooling device according to claim 11, wherein the cooling circuit is so constructed as to further include a heater passage for causing cooling medium flowing out from the body of the engine to flow into the body of the engine via a heater core, and a heater open-close valve for opening and closing the heater passage, and the controller opens the heater open-close valve in supplying cooling medium in the heat-accumulating container to the body of the engine through the heat-accumulating circuit by connecting the heat-accumulating passage to the cooling circuit, and closes the heater open-close valve in disconnecting the heat-accumulating passage from the cooling circuit.

14. The cooling device according to claim 13, wherein the cooling circuit is so constructed as to further include a throttle passage for causing cooling medium flowing out from the body of the engine to flow into the body of the engine via a throttle body, and a throttle open-close valve for opening and closing the throttle passage, and the controller opens the throttle open-close valve in supplying cooling medium in the heat-accumulating container to the body of the engine through the heat-accumulating circuit by connecting the heat-accumulating passage to the cooling circuit, and closes the throttle open-close valve in disconnecting the heat-accumulating passage from the cooling circuit.

15. The cooling device according to claim 11, wherein the controller determines that the engine has just been started, if cooling medium for cooling the body of the engine is at a temperature lower than a predetermined temperature.

16. The cooling device according to claim 11, wherein the controller determines that the engine has just been started, unless a predetermined time has elapsed since completion of the starting of the engine.

17. An engine cooling method comprising the steps of:

causing cooling medium to flow through a cooling circuit that is so constructed as to include a radiator passage for causing cooling medium flowing from a body of an engine to flow into the body of the engine via a radiator, a bypass passage for causing cooling medium flowing out from the body of the engine to flow into the body of the engine without flowing via the radiator, and a control valve for controlling a flow rate of cooling medium flowing through the bypass passage;

causing the cooling medium to flow through a heat-accumulating passage that is provided with a heat-accumulating container for storing the cooling medium in a thermally insulated state and that constitutes a heat-accumulating circuit for causing the cooling medium in the heat-accumulating container to circulate via the body of the engine by being selectively connected to the cooling circuit;

completing the heat-accumulating circuit by connecting the heat-accumulating passage to the cooling circuit to supply the cooling medium in the heat-accumulating container to the body of the engine and opening the control valve to increase a flow rate of cooling medium flowing through the bypass passage; and disconnecting the heat-accumulating passage from the cooling circuit and closing the control valve after opening the control valve.

18. The cooling method according to claim 17, wherein the control valve is opened before an operation of starting the engine, and the control valve is closed immediately after the engine has been started.

19. The cooling method according to claim 17, wherein the cooling circuit is so constructed as to further include a throttle passage for causing cooling medium flowing out from the body of the engine to flow into the body of the engine via a throttle body, and a throttle open-close valve for opening and closing the throttle passage, and the throttle open-close valve is opened in supplying cooling medium in the heat-accumulating container to the body of the engine through the heat-accumulating circuit by connecting the heat-accumulating passage to the cooling circuit, and is closed in disconnecting the heat-accumulating passage from the cooling circuit.

20. The cooling method according to claim 17, wherein the cooling circuit is so constructed as to further include a heater passage for causing cooling medium flowing out from the body of the engine to flow into the body of the engine via a heater core, and a heater open-close valve for opening and closing the heater passage, and the heater open-close value is opened in supplying cooling medium in the heat-accumulating container to the body of the body through the heat-accumulating circuit by connecting the heat-accumulating passage to the cooling circuit, and is closed in disconnecting the heat-accumulating passage from the cooling circuit.

21. The cooling method according to claim 17, wherein the heat-accumulating passage is prohibited from being connected to the cooling circuit if cooling medium in the heat-accumulating container is at a temperature lower than a predetermined temperature.

* * * * *